US008943966B2

(12) United States Patent
Berg et al.

(10) Patent No.: US 8,943,966 B2
(45) Date of Patent: Feb. 3, 2015

(54) PRINT PRESS HAVING DISPLAY DEVICE FOR POSITIONING PRESS COMPONENTS RELATIVE TO PRINT FREE LOCATIONS

(75) Inventors: Winfried Berg, Heidelberg (DE); Volkhard Franke, Schriesheim (DE); Dieter Hauck, Eberbach (DE); Till Maier, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 946 days.

(21) Appl. No.: 12/262,755

(22) Filed: Oct. 31, 2008

(65) Prior Publication Data

US 2009/0107354 A1 Apr. 30, 2009

(30) Foreign Application Priority Data

Oct. 31, 2007 (DE) ..... 10 2007 052 381

(51) Int. Cl.
*B41F 33/02* (2006.01)

(52) U.S. Cl.
CPC ..... *B41F 33/02* (2013.01)
USPC ..... 101/484; 101/480

(58) Field of Classification Search
USPC ..... 101/480, 484
IPC ..... B41J 33/02; B41F 33/02
See application file for complete search history.

(56) References Cited

U.S. PATENT DOCUMENTS 4,639,776 A * 1/1987 Foerster et al. ..... 348/61
5,163,012 A 11/1992 Wuhrl et al.
6,050,192 A 4/2000 Kipphan et al.
6,119,594 A 9/2000 Kipphan et al.
6,626,429 B2 * 9/2003 Hauck ..... 271/206
6,748,860 B2 * 6/2004 Loffler et al. ..... 101/365
7,860,587 B2 12/2010 Berg et al.
2002/0036379 A1 3/2002 Hauck
2002/0043758 A1 4/2002 Kelm et al.
2004/0168601 A1 * 9/2004 Petermann ..... 101/483
2005/0168700 A1 8/2005 Berg et al.
2005/0200863 A1 9/2005 Kiyohara
2007/0001385 A1 * 1/2007 Muller et al. ..... 271/182

FOREIGN PATENT DOCUMENTS

CN 1657284 A 8/2005
DE 2720674 A * 11/1978
DE 27 50 105 A1 5/1979
DE 38 05 902 A1 10/1988

(Continued)

OTHER PUBLICATIONS

European Search Report dated Mar. 9, 2009.

(Continued)

*Primary Examiner* — Leslie J Evanisko
(74) *Attorney, Agent, or Firm* — Laurence A. Greenberg; Werner H. Stemer; Ralph E. Locher

(57) ABSTRACT

A display device and a display method are provided for printing material processing machines having components disposed relative to a printing material. The display device and method are configured in such a way that changes in a relative position of the components of the machine are displayed on the display device in relation to the printed image and/or the printing material. A printing press having a display device is also provided.

5 Claims, 3 Drawing Sheets

(56) References Cited

FOREIGN PATENT DOCUMENTS

| | | | |
|---|---|---|---|
| DE | 39 24 989 | A1 | 2/1991 |
| DE | 42 39 052 | C1 | 6/1994 |
| DE | 44 13 230 | A1 | 10/1995 |
| DE | 197 09 083 | C1 | 10/1998 |
| DE | 101 34 836 | A1 | 2/2002 |
| DE | 101 40 825 | A1 | 5/2002 |
| DE | 103 17 064 | A1 | 7/2004 |
| DE | 10 2005 001 417 | A1 | 8/2005 |
| EP | 0884182 | A1 | 12/1998 |
| EP | 1 063 192 | A2 | 12/2000 |
| EP | 1 106 351 | A2 | 6/2001 |
| EP | 1 559 549 | A1 | 8/2005 |
| GB | 2 288 367 | A | 10/1995 |

OTHER PUBLICATIONS

German Trademark and Patent Office Search Report, dated Feb. 22, 2008.

* cited by examiner

PRINT PRESS HAVING DISPLAY DEVICE FOR POSITIONING PRESS COMPONENTS RELATIVE TO PRINT FREE LOCATIONS

CROSS-REFERENCE TO RELATED APPLICATION

This application claims the priority, under 35 U.S.C. §119, of German Patent Application DE 10 2007 052 381.7, filed Oct. 31, 2007; the prior application is herewith incorporated by reference in its entirety.

BACKGROUND OF THE INVENTION

Field of the Invention

The present invention relates to a display device and a display method for printing material processing machines having components disposed relative to a printing material. The invention also relates to a printing press having a display device.

In machines for processing printing materials, such as printing presses or folding machines for further print processing, the printing materials are transported as sheets or webs through various processing units belonging to the machine. Such processing units are printing units in printing presses and various folding devices in folding machines. In those processing units, it is important that the printing materials be transported through the machine and processed in an appropriately exact position. In particular in printing presses, that positional accuracy is important since, in multicolor printing on a printing material, the various color separations have to be printed exactly over one another in precise register. It is therefore important to know in what position relative to the cylinders in a printing unit, the printing materials are transported. It is possible for the relative position between the printing material and the cylinders in the printing unit to be adapted through register adjustment devices. Added thereto is the fact that the relative position of the printed image to the printing material can likewise be changed through register marks. In order to obtain an optimal print quality, those relative positions such as register and register marks must be checked regularly by the printer. There are appropriate measuring devices which are provided in order to check register marks and register. However, they are only able to detect afterward that positional deviations have occurred. It would therefore be advantageous for the printer if he or she were already able to check the effect of adjustments to components of the printing press on the position relative to the printing material when setting the machine.

German Published, Non-Prosecuted Patent Application DE 10 2005 001 417 A1, corresponding to U.S. Patent Application Publication No. US 2005/0168700 A1, discloses a projection device having a projection area which permits images to be projected on to a printed sheet. In that way it is possible to simulate changes made by the printer in the printing process through a corresponding projection on to the printing material. For instance, if the printer adjusts individual values of the opening of inking zones in the inking units of an offset printing press, he or she can have the changes made in the printed image displayed in a simulation by superimposing a projected printed image on the real printed image. That superimposition is calculated in a computer and projected on to the printed sheet by a projector. The changes projected in that way can be retracted again without difficulty by the printer if they do not meet his or her requirements. In that way, it is possible to save rejects which would otherwise necessarily arise in the event of incorrect settings, since those incorrect settings can only be detected afterward by visual inspection or appropriate measuring instruments.

However, the projection device of German Published, Non-Prosecuted Patent Application DE 10 2005 001 417 A1, corresponding to U.S. Patent Application Publication No. US 2005/0168700 A1, has the disadvantage that it is only changes on a printed sheet that can be simulated by using it. However, it is not possible to simulate and to represent changes to the settings in a printing press with regard to the components of the printing press, for example during the sheet transport, in relation to the relative position of a printed sheet or to the printed image on the printed sheet.

SUMMARY OF THE INVENTION

It is accordingly an object of the invention to provide a display device and a display method for printing material processing machines having components disposed relative to the printing material and a printing press having a display device, which overcome the hereinafore-mentioned disadvantages of the heretofore-known devices and methods of this general type and which permit checking a relative position of a printed image and/or the printing material in relation to the components.

With the foregoing and other objects in view there is provided, in accordance with the invention, in combination with a printing material processing machine having components disposed relative to a printing material, the improvement comprising a display device displaying a relative position of the components of the machine in relation to a printed image and/or the printing material by superimposing the components on the printed image and/or the printing material.

With the objects of the invention in view, there is also provided a method for displaying components of printing material processing machines relative to a printing material. The method comprises providing a display device and displaying a relative position of the components of the machine on the display device in relation to a printed image and/or the printing material by superimposing the components on the printed image and/or the printing material.

With the objects of the invention in view, there is furthermore provided a printing press, comprising a display device according to the invention.

According to the present invention, the display device is configured in such a way that changes in the relative position of the components of the machine are displayed on the display device in relation to the printed image and/or the printing material through the use of superimposition. As already mentioned at the outset, the relative position of the printed image and/or of the printing material, in particular in relation to transport components in a printing press, is of great importance for the print quality. If the printer then changes settings in the printing press, for example with regard to the register or register mark accuracy, then through the use of the present invention he or she is able to detect the effects of these settings on a printed sheet or the printing image by using the display device. For this purpose, the printed image and/or the printing material and the relevant components of the machine are displayed on a monitor in a superimposed representation. The superimposed representation is calculated in a computer belonging to the machine which, firstly, accepts input commands from the printer and to which, secondly, the settings on the printing press are known. The settings can be registered, for example through sensors, and transmitted to the machine computer. In addition, the printed image, the relative position of the printed image in relation to the printing material currently being used, the format of the printing material currently being used and the relative position of the printing material in the machine are known to the computer. This information can be known for the print job that is set up or for a future print job. This data is processed by the computer for the respective print job, in order to then be able to display it to the printer in a superimposition on a monitor.

In accordance with another feature of the invention, the adjustable components in printing material processing machines include, in particular, sheet brakes in the delivery. If the sheet brakes are not set up in such a way that they touch only the print-free regions of the printed image or printing material, then the sheet brakes leave traces on the printing material or the sheet deposits ink on the sheet brake. That necessarily leads to rejects and to additional cleaning work in the printing press. Through the use of the superimposed representation of the sheet brakes and of the printed image and/or the printing material on the monitor, the printer is then able to accurately detect the position of the sheet brakes with regard to the print-free regions of the printed image and to set the sheet brakes specifically so that they are located in the print-free regions.

In accordance with a further feature of the invention, the components of the machine are blowers or blower groups in a printing press. Sheet-fed printing presses have a large number of blowers or blower groups for the purpose of sheet transport, which transport the sheet in a defined manner through the sheet-fed printing press. Blowers are found in the delivery, in the connection between the delivery and the last printing unit, within the printing units and in the region of turning devices. In this case, a plurality of blowers always act simultaneously on a sheet, with the blowers not necessarily having to operate with the same volume of air. In order to optimize the transport, the blowers are instead set through corresponding profiles so that, for example, the blowers disposed at the edge of the group generate smaller quantities of air than the blowers disposed in the center of the group. However, these blower settings depend on the print format and on the printed image of the sheet currently being processed. Through the use of the superimposed representation of the printed image and/or of the printing material and of the blowers or blower groups in the printing press, it is then possible to make a direct local association between the blowers and the printing material or printed image detectable by the printer. In this way, the printer can see at a glance which blowers or blower groups he or she has to adjust in order to apply air deliberately to specific regions of the printing material.

In accordance with an added feature of the invention, the components are pull lays, front lays or side lays in a printing press. In the case of these components, the relative position of the printing material and the component also matters, which the printer can have displayed through the use of the superimposed representation on a monitor. Further components which are suitable for a corresponding superimposed representation are sheet grippers for the transport of printing materials in printing material processing machines. The optimal position of the sheet edges in the grippers can be determined through the use of settings of the position of the pull lays and/or of the pull path. In this case, the sheets are moved relative to the grippers. A similar procedure is carried out in the register adjustment. In this case, the sheets are also positioned in relation to the sheet grippers by lateral register.

In accordance with an additional feature of the invention, if the components in printing material processing machines are adjustable, they can be adjusted by using operating elements. These operating elements can be disposed in such a way as to be distributed around the display device but can also be disposed on the display device itself, for example if the latter is constructed as a touchscreen, so that the printer can make changes to the setting by simply touching the corresponding locations on the display device. For instance, if the sheet brakes are adjusted, then in the case of touchscreen operation, the printer merely needs to touch the sheet brakes with a finger and then pull them either to the right or to the left. In this way, the printer always immediately has the effects of the adjustment on the printing material or the printed image in view even during the adjustment, since the sheet brakes and printing material or printed image are always visible to him or her in a superimposed representation on the display device.

In accordance with yet another feature of the invention, the display device has a monitor in order to represent the printed image and/or printing material at least in original size. The representation of the printing material or printed image in the original size permits the printer particularly good assessment of the displayed image, since the same proportions are present in this case as those which prevail in a printing material that has been printed and placed on a checking table. In this case, it is advantageous if the display device includes a large flat monitor which has a high resolution, preferably at least 1920×1080 pixels HDTV resolution. Given such a high-resolution representation, even extremely small changes to the settings and effects on the relative position of the components in relation to the printing material or printed image can be made visible on the display device. If the monitor is fitted to the rear wall of a display device of a checking table with sheet support, then the printed sheet is still located between the monitor and the printer. Due to the distance of the printer from the monitor, it can even be expedient in this case for the monitor to be larger than the printing material being represented, so that the printer is better able to see details from a distance. On the other hand, a representation on a 1:1 scale offers the great advantage that the image displayed on the monitor can be compared directly on the same scale with the sheet lying in front of it on the support table.

In accordance with yet a further feature of the invention, print-free locations or points on the printing material and/or printed image resulting from an analysis of the printed image are calculated through the use of a computer as a proposed setting and displayed in marked form on the printing material and/or printed image as a proposed setting. In this case, the computer first analyzes the digitized printed image, to which it can make access through prepress data. The content of the printed image in the case of an electronic workflow is additionally normally present in the electronic job data, which can be interchanged through a network between the machines involved and the prepress stage. Since the print-free locations or points remain white, they can be detected reliably by the computer. Thus, the exact positions of the print-free locations or points on the printing material are known to the computer. Since the relative position of the printed image in relation to the printing material depends on the settings of the printing press, the computer should additionally have access to the settings of the printing press, in order to be able to take them into account as well. In this case, the computer can determine the print-free locations or points perfectly and then display them to the printer on the display device. The display can be carried out through the use of an appropriate marking on the printing material and/or printed image being displayed. For instance, the print-free locations or points can be outlined in red. In this way, it is made possible for the printer, for example, to displace the sheet brakes specifically into the print-free regions displayed on the display device.

In accordance with yet an added feature of the invention, the setting of the adjustable components are coordinated automatically by the computer with the print-free locations or points determined in the printed image and/or printing material. If the computer has determined the print-free locations or points, then it can also automatically carry out the settings of the corresponding components such as sheet brakes. In this case, provision can be made for the printer to also confirm the automatic setting by the computer through the use of an acknowledge signal through a pushbutton beside or on the display device.

In accordance with a concomitant feature of the invention, provision can additionally be made for there to be at least one further monitor, which displays the printing material and/or the printed image and/or is set up in order to accept operating commands. In the case of touchscreen operation, the monitor must be within the reach of the printer. If the monitor is fitted to the rear wall of an operating desk, it is difficult for the printer to reach the latter with his or her hands. Furthermore, touchscreens are available only in relatively small sizes, so that touchscreen operation is not possible in the case of large high-resolution monitors. In this case, there can be a second, smaller monitor, which is constructed as a touchscreen and is set up, in particular, to accept operating commands. Thus, the printer can then enter the operating commands through the touchscreen, and he or she receives the effects displayed on the large monitor. In addition, however, he or she can also receive the effects displayed on the smaller monitor, the touchscreen, if the printing material and/or the printed image are likewise displayed there in a superimposition on the corresponding components of the machine.

Other features which are considered as characteristic for the invention are set forth in the appended claims.

Although the invention is illustrated and described herein as embodied in a display device and a display method for printing material processing machines and a printing press having a display device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
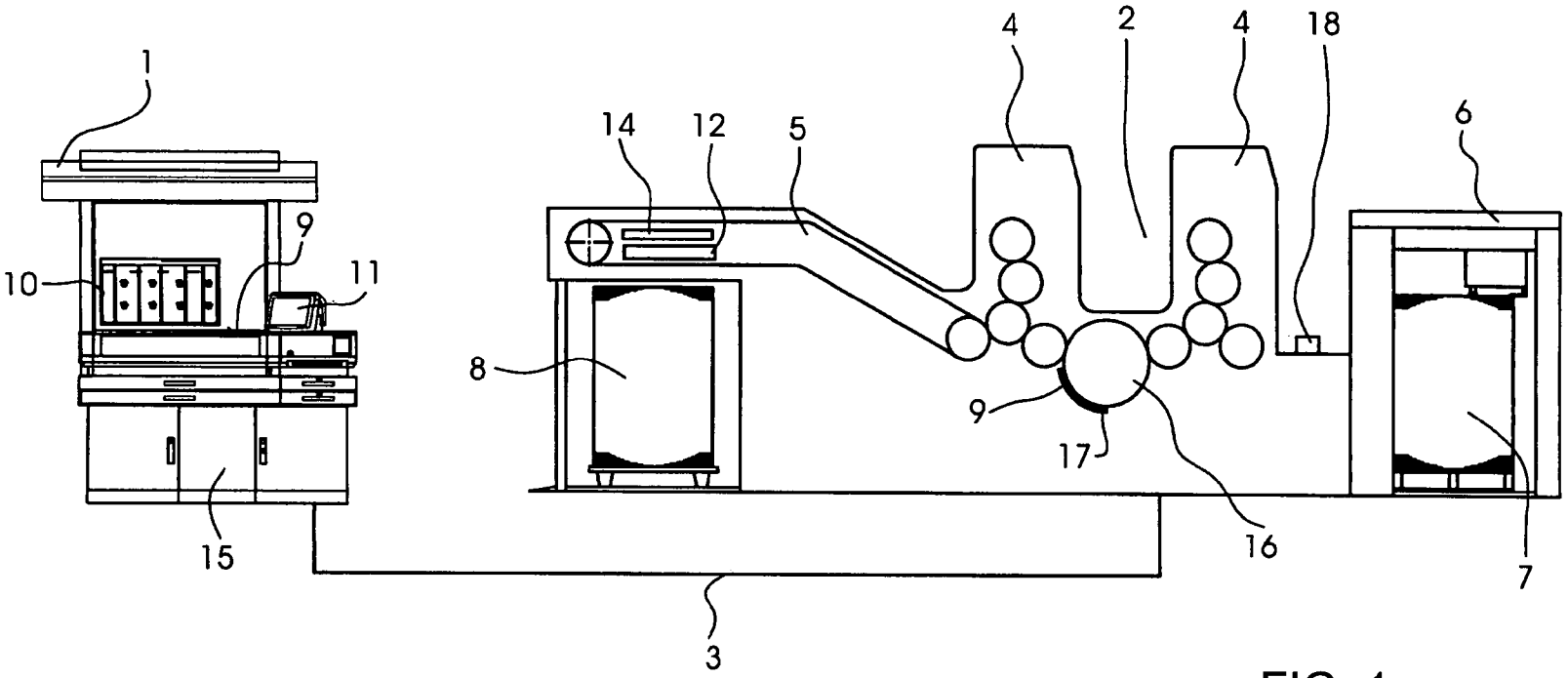
FIG. 1 is a diagrammatic, longitudinal-sectional view of a printing press and a front-elevational view of an operating desk thereof with a large monitor for representing a superimposition of printing material/printed image and machine components.

Referring now to the figures of the drawings in detail and first, particularly, to FIG. 1 thereof, there is seen an operating desk 1 having various operating devices, with which a sheet-fed printing press 2 is controlled. The operating desk or display device 1 has a control computer 15 and a large monitor 10, which has the same format as a sheet-type printing material 9 in the 75 cm×105 cm sheet format. In this way, it is possible to represent sheets 9 up to the format size 105 on the scale of 1:1 on the large monitor 10. The large monitor 10 has an HDTV resolution of 1920×1080 pixels for a detailed and faithful reproduction of sheets thereon. The large monitor 10 is mounted on a rear wall of the operating desk 1, so that the real printing material 9 can be laid in front of it on a support table. In this way, a printer has the sheet 9 and the sheet displayed on the large monitor 10 in the field of view at the same time. Furthermore, the operating desk 1 has an operating element in the form of a touchscreen 11, with which settings on the printing press 2 can be carried out. The touchscreen 11 is connected to the control computer 15, which in turn is connected to control components of the printing press 2 through a communications link 3.

Figure 2:
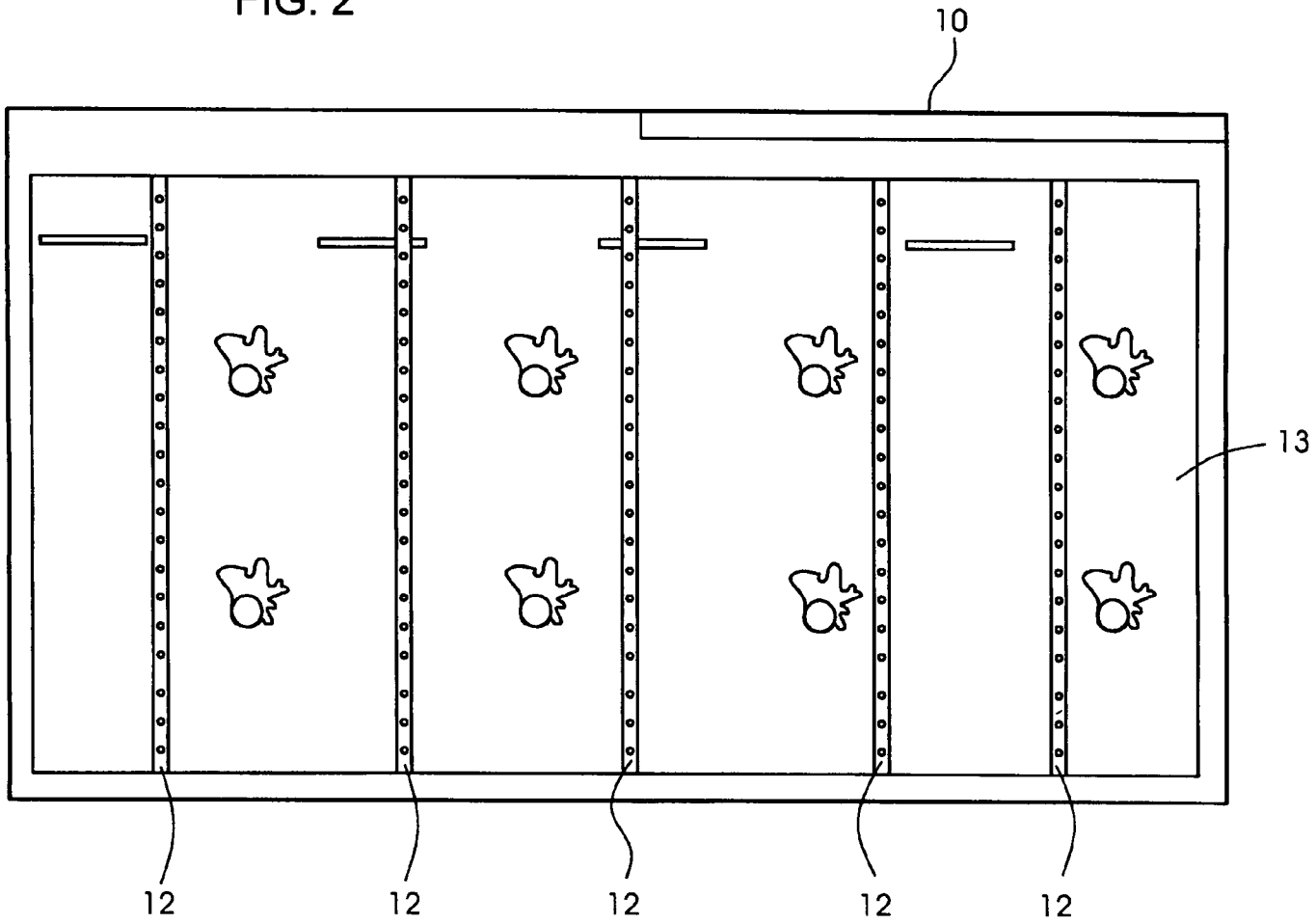
FIG. 2 is an enlarged, front-elevational view of the large monitor of the operating desk with a representation of a relative position of printing material/printed image and sheet brakes in a delivery of a printing press.

The printing press 2 in FIG. 1 has two printing units 4, by way of example, which are connected to one another through a transport cylinder 16. The printing press 2 has a sheet feeder 6 at an inlet of the first printing unit 4, which removes sheet-shaped printing materials 9 from a feeder stack 7 through the use of a suction head and feeds them to the first printing unit 4. The sheets are aligned laterally between the feeder 6 and the first printing unit 4 by pull lays 18. A sheet delivery 5, which is situated at an outlet of the second printing unit 4, deposits the finally printed sheets 9 on a delivery stack 8. During transport, the sheet-shaped printing materials 9 are held on the transport cylinder 16 in the printing press 2 through the use of sheet grippers 17. Sheet brakes 12, which are also shown in FIG. 2, are situated in the delivery 5. The position of the sheet brakes 12 can be set at the touchscreen 11 of the operating desk 1. A relative position of the sheet brakes 12 or other components with respect to the sheet-shaped printing material 9 and/or a printed image 13 on the printing material 9, can then be represented on the large monitor 10. To this end, the indicated sheet brakes 12 are superimposed on the printed image 13 of the printing material 9.

The superimposition of the sheet brakes 12 and the printed image 13 on the large monitor 10 is shown in FIG. 2. In order to ensure that the sheet brakes 12 do not leave any traces behind on the finally printed sheet 9, which would lead to rejects, the positions of the sheet brakes 12 must be set in such a way, in relation to the printed image 13 on the printing material 9, that they are located in print-free regions of the printed image 13. In order to visualize the relative position of the sheet brakes 12 in relation to the printed image 13 on the printing material 9, the position of the sheet brakes 12 in the delivery 5 of the printing press 2 is registered through sensors and transmitted to the control computer 15. A digital printing original from the current print job is additionally stored with the printed image 13 in the control computer 15, or the control computer 15 has access through a non-illustrated network to appropriate digital data from the prepress stage. The control computer 15 then uses the settings of the sheet brakes 12 and the digital data from the printed image 13 to calculate a superimposed semitransparent image, which is displayed on the large monitor 10. In addition, this image can also be displayed on the small touchscreen 11 of FIG. 1. If the printer then adjusts the position of the sheet brakes 12 of the printing press 2, these adjustments are reported back to the control computer 15, which immediately calculates a new superimposed image and displays it on the large monitor 10. In this way, the printer is able to see at a glance how his or her setting changes affect the relative position of the sheet brakes 12 in relation to the printed image 13.

Figure 3:
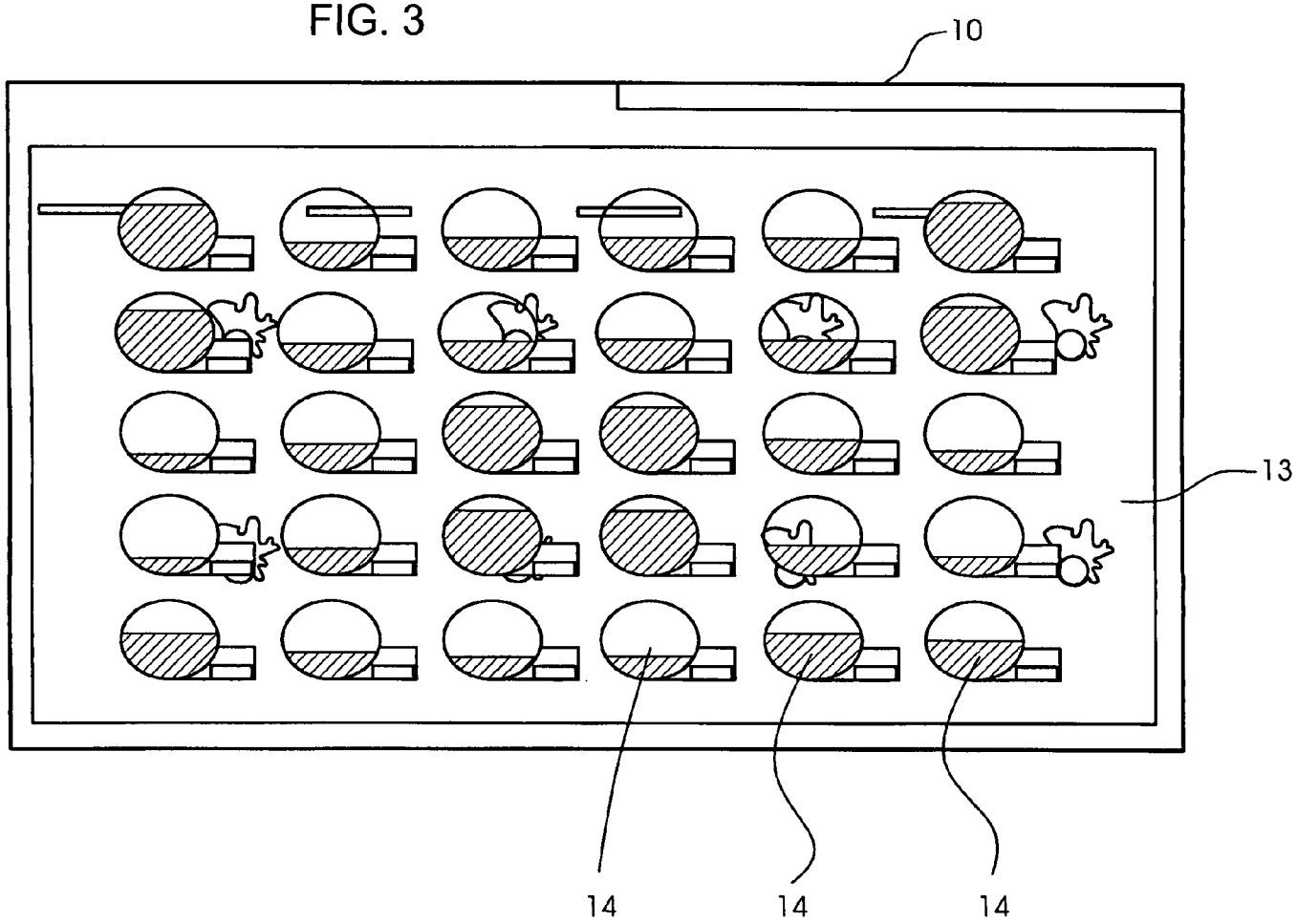
FIG. 3 is a front-elevational view of the large monitor with a superimposition of the printing material/printed image with blowers in the delivery of a printing press.

Another refinement of the invention is depicted in FIG. 3. In this case, it is not the position of components of a printing press 2 which can be adjusted but blowers 14 in the delivery 5 of the printing press 2. The blowers 14 are disposed in stationary fashion and serve to use a controlled airflow to deposit sheets 9 arriving in the delivery 5 on the delivery stack 8 after their release by gripper transport chains. The position of the printing material 9 in relation to the blowers 14 in the delivery 5 is, however, dependent on the format currently being used. If the maximum format is not being processed in the printing press 2, then the blowers 14 at the edge of the illustrated sheet 9 remain uncovered. These uncovered blowers 14 can then be detected by the operating personnel on the large monitor 10, since the outlines of the smaller sheet format 9 relative to the blowers 14 are also represented in this case. For this purpose, a superimposition of the printing material format actually being used on the printed image 13 and its relative position in the machine in relation to the blowers 14 disposed in the delivery 5, is displayed on the monitor 10. If the printer changes the airflow from individual blowers 14, then in this case he or she has an immediate association between the location of the blowers 14 and the location of the printing material 9 in view, so that it is possible to see the location of the printing material 9 on which the relevant blower 14 acts.

In the display of the sheet 9, it is additionally possible for the various types of production including recto printing, perfecting and, additionally, the turning or inversion to be taken into account, so that the printed image 13 which is currently coming into contact with the sheet brake 12 is always displayed. Furthermore, through appropriate menus on the touchscreen 11, the printer can access not only the current print job but also future print jobs and in this way already make the settings for any other formats during the print job still running and store them in the control computer 15. During the subsequent processing of the corresponding print job, it is then merely necessary for the settings already made to be retrieved from the memory of the control computer 15.

Besides the examples shown in FIGS. 2 and 3, further possible applications in the printing press 2 are also possible. In particular, the position of the sheet 9 and/or the position of the printed image 13 in relation to the grippers 17 on the transport cylinder 16 can be displayed on the large monitor 10. Furthermore, deliveries 5 normally have powdering devices, with which sticking of the finally printed sheets 9 deposited on the delivery stack 8 is prevented. In this way, a powder distribution and an active range of powder nozzles in the delivery 5 over the width and length in relation to the printing material 9 or the printed image 13 can also be displayed on the large monitor 10. The representation of the powder distribution can also be carried out as a function of the printing speed. In this case, the representation of the powder distribution on the monitor 10 changes as the printing speed changes. Furthermore, a representation of ink distribution and a result of an influence of lateral distribution in inking units of the printing units 4 in the printing press 2 can be represented on the large monitor 10. The common factor in all of the embodiments is that the relative position of the printing material 9 and/or the printed image 13 in relation to the corresponding components in the printing press 2 can be seen by the printer at a glance. This ensures reliable and convenient operation of the printing press 2.

The invention claimed is:

1. In combination with a printing material processing machine having adjustable components disposed relative to a printing material, the improvement comprising:

at least one printing unit;

a communications link;

a display device; and a control computer;

the control computer in communication with the printing unit and the display device via the communications link;

the control computer accepting input commands from the printing unit and storing print job data of the printing unit, the print job data transmitted to the control computer via the communications link, the print job data including positions of the adjustable components within the machine, the control computer analyzing a digitized print image of the print job data as a proposed setting to calculate print-free locations on the printing material;

the control computer transmitting the positions of the adjustable components and the calculated print-free locations to the display device via the communications link; and the display device displaying the calculated print free locations in marked form on at least one of the printing material or the printed image as a proposed setting on the display device, the display device also displaying a relative position of the adjustable components of the printing material processing machine in relation to at least one of a printed image or the printing material by superimposing the adjustable components on at least one of the printed image or the printing material;

wherein the position of the adjustable components of the machine can be adjusted relative to the at least one of the printing material or the printed image such that the adjustable components are placed in print-free locations on the printing material.

2. The combination according to claim 1, wherein the setting of the adjustable components is coordinated automatically by the control computer with the print-free locations determined in at least one of the printed image or the printing material.

3. The combination according to claim 1, which further comprises at least one further monitor displaying at least one of the printing material or the printed image.

4. The combination according to claim 3, wherein said at least one further monitor is configured to accept operating commands.

5. The combination according to claim 1, which further comprises at least one further monitor configured to accept operating commands.

* * * * *